US005104577A

United States Patent [19]

Ikeda et al.

[11] Patent Number: 5,104,577

[45] Date of Patent: Apr. 14, 1992

[54] SURFACE TREATMENT CHEMICALS AND BATH FOR ALUMINUM OR ITS ALLOY AND SURFACE TREATMENT METHOD

[75] Inventors: Satoshi Ikeda, Yamato; Shigeyuki Meguro, Yokohama, both of Japan

[73] Assignee: Nippon Paint Co., Ltd., Osaka, Japan

[21] Appl. No.: 561,420

[22] Filed: Aug. 1, 1990

[30] Foreign Application Priority Data

Aug. 1, 1989 [JP] Japan ..... 1-99656

[51] Int. Cl.[5] ..... C23F 11/18

[52] U.S. Cl. ..... 252/387; 422/7; 148/247; 148/248

[58] Field of Search ..... 148/247, 248; 252/387; 422/7

[56] References Cited

U.S. PATENT DOCUMENTS

| | | | |
|---|---|---|---|
| 4,187,127 | 2/1980 | Yashiro | 148/247 |
| 4,273,592 | 6/1981 | Kelly | 148/247 |
| 4,294,627 | 10/1981 | Heyes | 148/247 |
| 4,338,140 | 7/1982 | Reghi | 148/247 |
| 4,863,526 | 9/1989 | Miyagawa et al. | 148/13 |

FOREIGN PATENT DOCUMENTS

| | | |
|---|---|---|
| 156643 | 9/1952 | Australia . |
| 52-131937 | 11/1977 | Japan . |
| 0024232 | 2/1979 | Japan . |
| 55-6483 | 1/1980 | Japan . |
| 56-136978 | 10/1981 | Japan . |
| 737705 | 9/1955 | United Kingdom . |
| 2057300A | 4/1981 | United Kingdom . |

*Primary Examiner*—Deborah L. Kyle
*Assistant Examiner*—Valerie Fee
*Attorney, Agent, or Firm*—Sughrue, Mion, Zinn, Macpeak & Seas

[57] ABSTRACT

A surface treatment chemical for aluminum or its alloy consisting essentially of 10–1000 parts by weight of one or more ions of metals selected from the group consisting of scandium, yttrium, lanthanum, praseodymium, neodymium, samarium, europium, gadolinium, terbium, dysprosium, holmium, erbium, thulium, ytterbium and lutetium, 10–500 parts by weight of zirconium ion, 10–500 parts by weight of phosphate ion and 1–50 parts by weight of effective fluorine ion. A surface treatment bath for aluminum or its alloy consisting essentially of 10–1000 ppm of one or more ions of metals selected from the group consisting of scandium, yttrium, lanthanum, praseodymium, neodymium, samarium, europium, gadolinium, terbium, dysprosium, holmium, erbium, thulium, yttterbium and lutetium, 10–500 ppm of zirconium ion, 10–500 ppm of phosphate ion and 1–50 ppm of effective fluorine ion, and having a pH of 1.8–4.0.

10 Claims, 1 Drawing Sheet

SURFACE TREATMENT CHEMICALS AND BATH FOR ALUMINUM OR ITS ALLOY AND SURFACE TREATMENT METHOD

BACKGROUND OF THE INVENTION

The present invention relates to chemicals or a bath for surface-treating aluminum or its alloy, and more particularly to surface treatment chemicals or a bath suitable for the surface treatment of aluminum cans for drinks.

Aluminum and its alloy are conventionally subjected to a chemical treatment to provide them with corrosion resistance and to form undercoating layers thereon. A typical example of such chemical treatment is a treatment with a solution containing chromic acid, phosphoric acid and hydrofluoric acid. This method can provide a coating having high resistance to blackening by boiling water and high adhesion to a polymer coating film formed thereon. However, since the solution contains chromium (VI), it is hazardous to health and also causes problems of waste water treatment. Thus, various surface treatment solutions containing no chromium (VI) have already been developed.

For instance, Japanese Patent Publication No. 56-33468 discloses a coating solution for the surface treatment of aluminum, which contains zirconium, phosphate and an effective fluoride and has a pH of 1.5–4.0. Japanese Patent Laid-Open No. 56-136978 discloses a chemical treatment solution for aluminum or its alloy containing a vanadium compound, and a zirconium compound or a silicon fluoride compound. Further, Japanese Patent Publication No. 60-13427 discloses an acidic aqueous composition containing hafnium ion and fluorine ion.

With respect to the coating solution disclosed in Japanese Patent Publication No. 56-33468, it shows sufficient properties when it is a fresh solution, namely a newly prepared solution. However, after repeated use for chemical treatment, aluminum is accumulated in the solution by etching of the aluminum plates or sheets with fluorine. A conversion coating produced by such a coating solution does not show high resistance to blackening by boiling water which is used for sterilization, and it also has poor adhesion to a polymer coating film produced by paints, inks, lacquers, etc. In addition, the formed conversion coating does not have good slidability, and cans treated with this solution cannot smoothly be conveyed.

Further, the treatment solution disclosed in Japanese Patent Laid-Open No. 56-136978 needs a treatment at a relatively high temperature for a long period of time, preferably at 50°–80° C. for 3–5 minutes, and the formed conversion coating does not have sufficient resistance to blackening by boiling water and sufficient adhesion to a polymer coating film. In addition, since the formed conversion coating is grayish, it cannot be suitably applied to aluminum cans for drinks.

The composition disclosed in Japanese Patent Publication No. 60-13427 is also insufficient in resistance to blackening by boiling water and adhesion to a polymer coating film.

OBJECT AND SUMMARY OF THE INVENTION

Accordingly, an object of the present invention is to provide surface treatment chemicals for aluminum or its alloy free from the above problems inherent in the conventional techniques, which makes it possible to conduct a surface treatment at a low temperature for short time to provide a conversion coating excellent in resistance to blackening by boiling water, adhesion to a polymer coating film formed thereon and slidability, and which suffers from little deterioration with time, so that it can provide a conversion coating having the above properties even when it is not a fresh one.

Another object of the present invention is to provide a surface treatment bath for aluminum or its alloy having such characteristics.

As a result of intense research in view of the above objects, the inventors have found that a combination of particular proportions of one or more ions of metals selected from the group consisting of scandium, yttrium, lanthanum, praseodymium, neodymium, samarium, europium, gadolinium, terbium, dysprosium, holmium, erbium, thulium, ytterbium and lutetium, zirconium ion, phosphate ion and effective fluorine ion can provide surface treatment chemicals and a bath free from any problems of the conventional techniques. The present invention is based on this finding.

Thus, the surface treatment chemicals for aluminum or its alloy according to the present invention consist essentially of 10–1000 parts by weight of one or more ions of metals selected from the group consisting of scandium, yttrium, lanthanum, praseodymium, neodymium, samarium, europium, gadolinium, terbium, dysprosium, holmium, erbium, thulium, ytterbium and lutetium, 10–500 parts by weight of zirconium ion, 10–500 parts by weight of phosphate ion and 1–50 parts by weight of effective fluorine ion.

The surface treatment bath for aluminum or its alloy according to the present invention consists essentially of 10–1000 ppm of one or more ions of metals selected from the group consisting of scandium, yttrium, lanthanum, praseodymium, neodymium, samarium, europium, gadolinium, terbium, dysprosium, 10 holmium, erbium, thulium, ytterbium and lutetium, 10–500 ppm of zirconium ion. 10–500 ppm of phosphate ion and 1–50 ppm of effective fluorine ion, and has a pH of 1.8–4.0.

The method of surface-treating aluminum or its alloy comprises the steps of applying to said aluminum or its alloy a surface treatment bath consisting essentially of 10–1000 ppm of one or more ions of metals selected from the group consisting of scandium, yttrium, lanthanum, praseodymium, neodymium, samarium, europium, gadolinium, terbium, dysprosium, holmium, erbium, thulium, ytterbium and lutetium, 10–500 ppm of zirconium ion, 10–500 ppm of phosphate ion and 1–50 ppm of effective fluorine ion, and having a pH of 1.8–4.0, at a temperature between room temperature and 50° C.

DETAILED DESCRIPTION OF THE INVENTION

Figure 1:
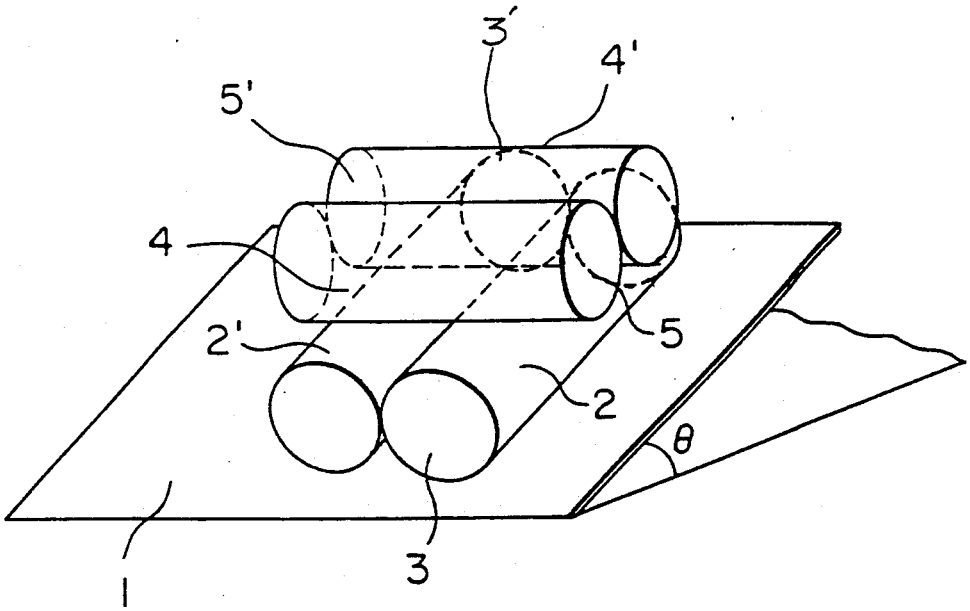
FIG. 1 is perspective view for showing a method of measuring the slidability of coated cans.

The surface treatment chemicals of the present invention contain particular proportions of substances suitable for the surface treatment of aluminum or its alloy, and it is diluted to a proper concentration as a surface treatment bath. Specifically, the surface treatment chemicals contains 10–1000 parts by weight of one or more ions of metals selected from the group consisting of scandium, yttrium, lanthanum, praseodymium, neodymium, samarium, europium, gadolinium, terbium, dysprosium, holmium, erbium thulium, ytterbium and lutetium (10–1000 ppm as a concentration in a surface treatment bath, same in the following). The above metal and metal ion will be called "selected metal" and "selected metal ion," hereinafter. The preferred selected metals are scandium, yttrium, lanthanum, praseodymium and neodymium, and more preferable metals are scandium, yttrium and lanthanum.

When the content of the selected metal ion is less than 10 parts by weight (10 ppm), the formed conversion coating is turned black when treated with boiling water for sterilization, meaning that it is poor in resistance to blackening by boiling water. Further, it is poor in adhesion to a polymer coating film formed by painting, printing, etc. and slidability. On the other hand, when the amount of the selected metal ion exceeds 1000 parts by weight (1000 ppm), further improvement due to the addition of the selected metal ion cannot be obtained. Thus, from the economic point of view, 1000 parts by weight (1000 ppm) of the selected metal ion is sufficient. The preferred content of the selected metal ion is 25–500 parts by weight (25–500 ppm). and more preferably 25–200 parts by weight (25–200) ppm.

Sources of the selected metal ion include soluble salts such as nitrates, sulfates, halides, etc. of the selected metals, and particularly the nitrates are preferable.

The surface treatment chemicals (surface treatment bath) of the present invention further contains zirconium ion. The sources of zirconium ion include $H_2ZrF_6$, $(NH_4)_2ZrF_6$, $Na_2ZrF_6$, $K_2ZrF_6$, $Zr(NO_3)_4$, $ZrO(NO_3)_2$, $Zr(SO_4)_2$, $ZrOSO_4$, etc., and particularly $(NH_4)_2ZrF_6$ is preferable. The content of zirconium ion is 10–500 parts by weight (10–500 ppm). When it is less than 10 parts by weight (10 ppm), a conversion coating-forming rate is extremely low, failing to produce a sufficient conversion coating. However, even though it exceeds 500 parts by weight (500 ppm), further effects cannot be obtained. Thus, from the economic point of view, it would be sufficient if it is up to 500 parts by weight (500 ppm). The preferred content of zirconium ion is 20–100 parts by weight (20–100 ppm).

The surface treatment chemicals (surface treatment bath) of the present invention further contain 10–500 parts by weight (10–500 ppm) of phosphate ion. When the content of phosphate ion is less than 10 parts by weight (10 ppm), the formed conversion coating has poor adhesion to a polymer coating film. On the other hand, when it exceeds 500 parts by weight (500 ppm), the formed conversion coating becomes poor not only in resistance to blackening by boiling water but also in adhesion to a polymer coating film, and further $Zr{\cdot}M{\cdot}Al{-}PO_4$ (M represents a selected metal) tends to be precipitated in the surface treatment bath. The preferred content of phosphate ion is 25–200 parts by weight (25–200 ppm). The sources of phosphate ion include $H_3PO_4$, $NaH_2PO_4$, $(NH_4)H_2PO_4$, etc., and particularly $H_3PO_4$ is preferable.

The surface treatment chemicals (surface treatment bath) of the present invention further contain 1–50 parts by weight (1–50 ppm), preferably 3–20 parts by weight (3–20 ppm) fluorine ion is less than 1 part by weight (1 ppm), substantially no etching reaction of aluminum takes place, failing to form a conversion coating. On the other hand, when it exceeds 50 parts by weight (50 ppm), an aluminum etching rate becomes higher than a conversion coating-forming rate, deterring the formation of the conversion coating. In addition, even though a conversion coating is formed, it is poor in resistance to blackening by boiling water and adhesion to a polymer coating film. Incidentally, the term "effective fluorine ion" means isolated fluorine ion, and its concentration can be determined by measuring a treatment solution by a meter with a fluorine ion electrode. Thus, fluoride compounds from which fluorine ion is not isolated in the surface treatment solution cannot be regarded as the sources of effective fluorine ion. The suitable sources of effective fluorine ion include HF, $NH_4F$, NH NaF, $NaHF_2$, etc., and particularly HF is preferable.

The surface treatment bath is generally produced by diluting the surface treatment chemicals to a proper concentration,. The resulting surface treatment bath should have a pH of 1.8–4.0. When the pH of the surface treatment bath is lower than 1.8, too much etching reaction of aluminum takes place, deterring the formation of the conversion coating. On the other hand, when it exceeds 4.0, $Zr{\cdot}M{\cdot}Al{-}PO_4$ tends to be precipitated. The preferred pH of the surface treatment bath is 2.6–3.2.

The pH of the surface treatment bath may be controlled by pH-adjusting agents. The pH-adjusting agents are preferably nitric acid, sulfuric acid, ammonium aqueous solution, etc. Phosphoric acid can serve as a pH-adjusting agent, but it should be noted that it cannot be added in an amount exceeding the above range because it acts to deteriorate the properties of the resulting conversion coating.

The surface treatment chemicals (surface treatment bath) of the present invention may optionally contain organic chelating agents of aluminum derived from gluconic acid (or its salt), heptonic acid (or its salt), etc.

The surface treatment chemicals of the present invention may be prepared by adding the above components to water as an aqueous concentrated solution, and they may be diluted by a proper amount of water to a predetermined concentration with its pH adjusted, if necessary, to provide the surface treatment bath of the present invention.

The application of the surface treatment bath to aluminum or its alloy can be conducted by any methods such as an immersion method, a spraying method, a roll coat method, etc. The application is usually conducted between room temperature and 50° C., preferably at a temperature of 30–40° C. The treatment time may vary depending upon the treatment method and the treatment temperature, but it is usually as short as 5–60 sec.

Incidentally, aluminum or its alloy to which the surface treatment bath of the present invention is applicable includes aluminum, aluminum-copper alloy, aluminum-manganese alloy, aluminum-magnesium alloy, aluminum-magnesium-silicon alloy, aluminum-zinc alloy, alulminum-zinc-magnesium alloy, etc. It may be used in any shape such as a plate, a rod, a wire,, a pipe, etc. Particularly, the surface treatment bath of the present invention is suitable for treating aluminum cans for soft drinks, alcohol beverages, etc.

By treating aluminum or its alloy with the surface treatment bath of the present invention, the aluminum is etched with effective fluorine ion, and forms a double salt with the selected metal ion, zirconium ion, phosphate ion and fluorine ion, thereby forming a strong conversion coating. It is presumed that zirconium serves as an accelerator of the precipitation of the selected metal. When the conversion coating is further printed or painted, the conversion coating shows extremely high adhesion to such a polymer coating film. This high adhesion seems to be derived from interaction of the selected metal and the polymer coating film. Thus, by the interaction of the selected metal ion, zirconium ion, phosphate ion and effective fluorine ion, a conversion coating with good corrosion resistance, high resistance to blackening by boiling water and slidability can be obtained.

The present invention will be explained in further detail by the following Examples and Comparative Examples. In Examples and Comparative Examples, resistance to blackening by boiling water, adhesion to a polymer coating film and slidability are evaluated as follows:

(1,) Resistance to blackening by boiling water

Each aluminum can treated with a surface treatment bath is dried, and a bottom portion is cut off from the can, and then immersed in boiling water at 100° C for 30 minutes. After that, the degree of blackening is evaluated as follows:

Excel.: Not blackened at all.

Good: Slightly blackened.

Fair: Lightly blackened.

Poor: Considerably blackened.

(2) Adhesion to polymer coating film

Each aluminum can treated with a surface treatment bath is dried, and its outer surface is further coated with an epoxy-phenol paint (Finishes A, manufactured by Toyo Ink Manufacturing Co., Ltd.) and then baked. A polyamide film of 40 μm in thickness (Diamide Film #7000 manufactured by Daicel Chemical Industries. Ltd.) is interposed between two of the resulting coated plates and subjected to hot pressing. A 5-mm-wide test piece is cut off from the hot pressed plates, and to evaluate the adhesion of each test piece, its peel strength is measured by a T-peel method and a 180° peel method. The unit of the peel strength is kgf/5 mm. Incidentally, the adhesion measured on a test piece before immersion in boiling water is called "primary adhesion," and the adhesion measured on a test piece after immersion in tap water at 90° C. for 7.5 hours is called "secondary adhesion."

(3) Slidability

As shown in FIG. 1, two surface-treated aluminum cans 2, 2′ are fixed to a sliding plate 1 whose inclination angle $\theta$ can be changed, with a double-sided adhesive tape in such a manner that opposite bottoms 3,3′ of the aluminum cans 2,2′ face downward (lines of rolling are horizontal). Two additional surface-treated aluminum cans 4,4′ are placed on the aluminum cans 2,2′ perpendicularly in such a manner that each bottom 5,5′ of the cans 4,4′ faces oppositely, and that lines by rolling is directed vertically. Further, the two cans 4,4′ are fixed to each other with a double-sided adhesive tape in side portions not in contact with the lower cans 2,2′.

By raising the sliding plate 1 to increase its inclination angle $\theta$, an angle $\theta$at which the upper two cans 4, 4′ start to slide is measured. A friction constant is calculated from tan $\theta$. The friction coefficient is evaluated as follows:

Good: 0.7 or more and less than 0.8.

Fair: 0.8 or more and less than 0.9.

Poor: 0.9 or more and less than 1.0.

Very poor: 1.0 or more.

EXAMPLES 1-25

An aluminum sheet (JIS A 3004) is formed Into a can by a Drawing & Ironing method, and degreased by spraying an acidic cleaner (Surfcleaner NHC 100 manufactured by Nippon Paint Co., Ltd.). After washing with water, it is sprayed with a surface treatment bath having the composition and pH shown in Table 1 at 40° C. for 30 sec. Next, it is washed with water and then with deionized water, and then dried in an oven at 200° C. After drying, each can is tested with respect to resistance to blackening by boiling water, adhesion to a polymer coating film and slidability. The results are shown in Table 2.

TABLE 1

| Example No. | Selected Metal Ion (1) Type | Selected Metal Ion (1) (ppm) | Zirconium Ion (2) (ppm) | Phosphate Ion (3) (ppm) | Effective Fluorine Ion (4) (ppm) | pH(5) |
|---|---|---|---|---|---|---|
| 1 | Sc | 50 | 25 | 50 | 8 | 2.8 |
| 2 | Sc | 25 | 25 | 50 | 8 | 2.8 |
| 3 | Sc | 25 | 50 | 50 | 8 | 2.8 |
| 4 | Y | 50 | 25 | 50 | 8 | 2.8 |
| 5 | Y | 25 | 25 | 50 | 8 | 2.8 |
| 6 | Y | 50 | 50 | 50 | 8 | 2.8 |
| 7 | La | 50 | 25 | 50 | 8 | 2.8 |
| 8 | La | 50 | 25 | 50 | 8 | 2.5 |
| 9 | La | 50 | 25 | 50 | 8 | 3.1 |
| 10 | Pr | 50 | 25 | 50 | 8 | 2.8 |
| 11 | Pr | 50 | 25 | 25 | 8 | 2.8 |
| 12 | Pr | 50 | 25 | 200 | 8 | 2.8 |
| 13 | Nd | 50 | 25 | 50 | 8 | 2.8 |
| 14 | Nd | 50 | 25 | 50 | 3 | 2.8 |
| 15 | Nd | 50 | 25 | 50 | 20 | 2.8 |
| 16 | Sm | 50 | 25 | 50 | 8 | 2.8 |
| 17 | Eu | 50 | 25 | 50 | 8 | 2.8 |
| 18 | Gd | 50 | 25 | 50 | 8 | 2.8 |
| 19 | Tb | 50 | 25 | 50 | 8 | 2.8 |
| 20 | Dy | 50 | 25 | 50 | 8 | 2.8 |
| 21 | Ho | 50 | 25 | 50 | 8 | 2.8 |
| 22 | Er | 50 | 25 | 50 | 8 | 2 8 |
| 23 | Tm | 50 | 25 | 50 | 8 | 2.8 |
| 24 | Yb | 50 | 25 | 50 | 8 | 2.8 |
| 25 | Lu | 50 | 25 | 50 | 8 | 2.8 |

Note
(1): Added as nitrate.
(2): Added as $(NH_4)_2ZrF_6$.
(3): Added as $H_3PO_4$.
(4): Added as HF.
(5)Controlled with $HNO_3$ and an ammonium aqueous solution.

TABLE 2

| Example No. | Resistance to Blackening by Boiling Water | Adhesion of Coating Film: T-Peel Method Prim. | T-Peel Method Sec. | 180°-Peel Method Prim. | 180°-Peel Method Sec. | Slidability |
|---|---|---|---|---|---|---|
| 1 | Excel. | 4.8 | 2.3 | 4.2 | 2.9 | Good |
| 2 | Good | 4.6 | 2.2 | 4.2 | 2.7 | Good |
| 3 | Good | 4.5 | 2.1 | 4.0 | 2.8 | Good |
| 4 | Excel. | 5.0 | 2.4 | 4.2 | 3.0 | Good |
| 5 | Good | 4.9 | 2.4 | 4.1 | 2.8 | Good |
| 6 | Excel. | 5.0 | 2.3 | 4.0 | 2.9 | Good |
| 7 | Excel. | 5.1 | 2.2 | 4.3 | 2.8 | Good |
| 8 | Excel. | 5.0 | 2.3 | 4.2 | 2.9 | Good |
| 9 | Excel. | 4.7 | 2.1 | 4.1 | 2.7 | Good |
| 10 | Excel. | 4.7 | 2.1 | 4.0 | 2.6 | Good |
| 11 | Excel. | 4.5 | 2.0 | 3.9 | 2.6 | Good |
| 12 | Good | 4.6 | 2.2 | 4.1 | 2.6 | Good |
| 13 | Excel. | 4.5 | 2.0 | 4.1 | 2.6 | Good |
| 14 | Excel. | 4.6 | 2.0 | 4.0 | 2.7 | Good |
| 15 | Excel. | 4.8 | 2.1 | 3.9 | 2.8 | Good |
| 16 | Excel. | 4.5 | 2.1 | 4.1 | 2.8 | Good |
| 17 | Excel. | 4.6 | 2.1 | 4.2 | 2.7 | Good |
| 18 | Excel. | 4.9 | 2.3 | 4.0 | 2.9 | Good |
| 19 | Excel. | 4.8 | 2.2 | 3.9 | 2.8 | Good |
| 20 | Excel. | 4.8 | 2.0 | 4.2 | 2.7 | Good |
| 21 | Excel. | 4.6 | 2.2 | 4.3 | 2.8 | Good |
| 22 | Excel. | 5.1 | 2.2 | 4.1 | 3.0 | Good |
| 23 | Excel. | 4.7 | 2.0 | 4.0 | 3.0 | Good |
| 24 | Excel. | 4.6 | 2.0 | 3.9 | 2.8 | Good |
| 25 | Excel. | 4.5 | 2.2 | 4.0 | 2.7 | Good |

COMPARATIVE EXAMPLES 1-8

For comparison, surface treatment baths having the compositions and pH shown in Table 3 are prepared. The same surface treatment of an aluminum can as in Example 1 is conducted by using each surface treatment, and the same tests as in Example 1 are conducted. The results are shown in Table 4.

TABLE 3

| Compara. Example No. | Lanthanum Ion (1) (ppm) | Zirconium Ion (2) (ppm) | Phosphate Ion (3) (ppm) | Effective Fluorine Ion (4) (ppm) | pH(5) |
|---|---|---|---|---|---|
| 1 | 5 | 25 | 50 | 8 | 2.8 |
| 2 | 50 | 5 | 50 | 8 | 2.8 |
| 3 | 50 | 25 | 5 | 8 | 2.8 |
| 4 | 50 | 25 | 50 | 0.3 | 2.8 |
| 5 | 50 | 25 | 50 | 8 | 1.5 |
| 6 | 50 | 25 | 50 | 8 | 4.2 |
| 7 | — | 25 | 50 | 20 | 2.8 |
| 8 | 50 | — | 50 | 8 | 2.8 |

Note
(1): Added as $La(NO_3)_3.6H_2O$.
(2): Added as $(NH_4)_2ZrF_6$.
(3): Added as $H_3PO_4$.
(4): Added as HF.
(5)Controlled with $HNO_3$ and an ammonium aqueous solution.

TABLE 4

| Compara. Example No. | Resistance to Blackening by Boiling Water | Adhesion of Coating Film: T-Peel Method Prim. | T-Peel Method Sec. | 180°-Peel Method Prim. | 180°-Peel Method Sec. | Slidability |
|---|---|---|---|---|---|---|
| 1 | Poor | 2.0 | 0.6 | 2.6 | 1.6 | Poor |
| 2 | Very Poor | 0.8 | 0.3 | 2.3 | 0.9 | Poor |
| 3 | Poor | 1.8 | 0.7 | 2.0 | 1.2 | Fair |
| 4 | Very Poor | 0.7 | 0.3 | 2.1 | 0.8 | Poor |
| 5 | Fair | 2.1 | 0.6 | 2.1 | 1.4 | Fair |
| 6 | Fair | 1.8 | 0.7 | 1.9 | 0.9 | Fair |
| 7 | Poor | 2.0 | 0.7 | 2.4 | 1.6 | Poor |
| 8 | Very Poor | 0.8 | 0.3 | 1.7 | 0.8 | Poor |

As is clear from the above results, in the case of treatment with the surface treatment bath of the present invention (Examples 1-25), the formed conversion coatings are good in resistance to blackening by boiling water, adhesion to a polymer coating film and slidability. On the other hand, when the selected metal ion is less than 10 ppm (10 parts by weight) (Comparative Examples 1 and 7). the formed conversion coatings are poor in resistance to blackening by boiling water, adhesion to a polymer coating film and slidability. And when zirconium is less than 10 ppm (10 parts by weight) (Comparative Examples 2 and 8), and when effective fluorine ion is less than 1 ppm (1 parts by weight) (Comparative Example 4), sufficient conversion coatings are not formed, and they are poor in resistance to blackening by boiling water, adhesion to a polymer coating film and slidability. Further, when phosphate ion is less than 10 ppm (10 parts by weight) (Comparative Example 3,), the resulting conversion coating is poor in resistance to blackening by boiling water and adhesion to a polymer coating film. When the pH of the surface treatment bath is less than 1.8 (Comparative Example 5), a conversion coating is not easily formed, and the formed conversion coating is slightly blackened and shows poor adhesion to a polymer coating film. On the other hand, when the pH exceeds 4.0 (Comparative Example 6), the treating bath becomes cloudy because of precipitation, and the resulting conversion coating is slightly poor in resistance to blackening by boiling water and also shows poor adhesion to a polymer coating film.

As described above in detail, with the surface treatment chemicals (surface treatment bath) of the present invention, a conversion coating having extremely high corrosion resistance can be formed on a surface of aluminum or its alloy at a low temperature in a very short time. The conversion coating thus formed is highly resistant to blackening even when immersed in boiling water,. meaning that it has excellent resistance to blackening by boiling water even in a thin layer. In addition, when a polymer coating film is formed on the conversion coating by painting or printing, extremely strong adhesion between them can be achieved. Further, since the conversion coating shows good slidability, it is extremely advantageous in conveying.

Since the surface treatment chemicals, (surface treatment bath) of the present invention shows sufficient characteristics even though its concentration is varied, it is not required to strictly control the concentration of the surface treatment bath.

The surface treatment chemicals (surface treatment bath) having such advantages are highly suitable for the surface treatment of aluminum cans, etc.

What is claimed is:

1. A surface treatment aqueous solution for aluminum or its alloy consisting essentially of 10-1000 parts by weight of one or more ions of metals selected from the group consisting of scandium, yttrium, lanthanum, praseodymium, neodymium,; samarium, europium, gadolinium, terbium, dysprosium, holmium, erbium, thulium, ytterbium and lutetium, 10-500 parts by weight of zirconium ion, 10-500 parts by weight of phosphate ion and 1-50 parts by weight of effective fluorine ion.

2. The surface treatment aqueous solution according to claim 1, wherein said metal ion is present in an amount of 25-500 parts by weight, said zirconium ion is present in an amount of 20-100 parts by weight, said phosphate ion is present in an amount of 25-200 parts by weight, and said effective fluorine ion is present in an amount of 3-20 parts by weight.

3. The surface treatment aqueous solution according to claim 1, wherein said metal ion is one or more ions of, metals selected from the group consisting of scandium, yttrium, lanthanum, praseodymium and neodymium.

4. The surface treatment aqueous solution according to claim 2, wherein said metal ion is one or more ions of metals selected from the group consisting of scandium, yttrium, lanthanum, praseodymium and neodymium.

5. The surface treatment aqueous solution according to claim 1, wherein said metal ion is one or more ions of metals selected from the group consisting of scandium, yttrium and lanthanum.

6. The surface treatment aqueous solution according to claim 2, wherein said metal ion is one or more ions of metals selected from the group consisting of scandium, yttrium and lanthanum.

7. A surface treatment bath for aluminum or its alloy consisting essentially of 10-1000 ppm of one or more ions of metals selected from the group consisting of scandium, yttrium, lanthanum, praseodymium, neodymium, samarium, europium, gadolinium, terbium, dysprosium, holmium, erbium, thulium,; ytterbium and lutetium, 10-500 ppm of zirconium ion, 10-500 ppm of phosphate ion and 1-50 ppm of effective fluorine ion, and having a pH of 1.8-4.0.

8. The surface treatment bath according to claim 7, wherein said metal ion is present in an amount of 25-500 ppm, said zirconium ion is present in an amount of 20–100 ppm, said phosphate ion is present in an amount of 25–200 ppm, said effective fluorine ion is present in an amount of 3–20 ppm, and said bath has a pH of 2.6–3.2.

9. A method of surface-treating aluminum or its alloy comprising the steps of applying to said aluminum or its alloy a surface treatment bath consisting essentially of 10–1000 ppm of one or more ions of metals selected from the group consisting of scandium, yttrium, lanthanum, praseodymium, neodymium, samarium, europium, gadolinium, terbium, dysprosium, holmium, erbium, thulium, ytterbium and lutetium, 10–500 ppm of zirconium ion, 10–500 ppm of phosphate ion and 1–50 ppm of effective fluorine ion, and having a pH of 1.8–4.0, at a temperature between room temperature and 50° C.

10. The method according to claim 9, wherein the temperature of said surface treatment bath is 30–40° C., and the surface treatment time is 5–60 seconds.

* * * * *